US010181702B2

(12) United States Patent
Suzuki et al.

(10) Patent No.: US 10,181,702 B2
(45) Date of Patent: Jan. 15, 2019

(54) SPARK PLUG

(71) Applicant: NGK SPARK PLUG CO., LTD., Nagoya-shi, Aichi (JP)

(72) Inventors: Kaori Suzuki, Nagoya (JP); Tomoaki Kato, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/755,746

(22) PCT Filed: Jun. 8, 2016

(86) PCT No.: PCT/JP2016/002771
§ 371 (c)(1),
(2) Date: Feb. 27, 2018

(87) PCT Pub. No.: WO2017/037969
PCT Pub. Date: Mar. 9, 2017

(65) Prior Publication Data

US 2018/0248340 A1 Aug. 30, 2018

(30) Foreign Application Priority Data

Sep. 4, 2015 (JP) ..... 2015-174520

(51) Int. Cl.
*H01T 13/32* (2006.01)
*H01T 13/39* (2006.01)
(Continued)

(52) U.S. Cl.
CPC ..... *H01T 13/32* (2013.01); *H01T 13/20* (2013.01); *H01T 13/39* (2013.01); *H01T 13/38* (2013.01)

(58) Field of Classification Search
None
See application file for complete search history.

(56) References Cited

U.S. PATENT DOCUMENTS 4,670,684 A 6/1987 Kagawa et al.
5,465,022 A 11/1995 Katoh et al.
(Continued)

FOREIGN PATENT DOCUMENTS

EP 2348590 * 2/2011
JP S59-160988 9/1984
(Continued)

OTHER PUBLICATIONS

International Search Report from correspoding International Patent Application No. PCT/JP16/02771, dated Sep. 13, 2016.
(Continued)

*Primary Examiner* — Ashok Patel
(74) *Attorney, Agent, or Firm* — Kusner & Jaffe

(57) ABSTRACT

A spark plug wherein when a discharge tip is viewed from a direction of an axial line, a melted portion is formed in at least a region on a second-end side of an electrode base material from a center of a discharge layer, and wherein in a section that includes a center line along a longitudinal direction of a ground electrode and that is parallel to an axial line, a proportion of a length of the melted portion along the longitudinal direction to a length of the discharge tip along the longitudinal direction of the electrode base material is greater than or equal to 76.2%, with the length of the melted portion along the longitudinal direction being within a range in which the discharge tip exists along the longitudinal direction.

4 Claims, 13 Drawing Sheets

(51) Int. Cl.
*H01T 13/20* (2006.01)
*H01T 13/38* (2006.01)

(56) References Cited

U.S. PATENT DOCUMENTS

| | | | | |
|---|---|---|---|---|
| 2010/0264801 | A1 | 10/2010 | Tanaka et al. | |
| 2012/0019120 | A1* | 1/2012 | Nakayama | H01T 13/39 313/141 |
| 2013/0200773 | A1* | 8/2013 | Sakayanagi | H01T 13/32 313/141 |
| 2013/0214670 | A1* | 8/2013 | Suzuki | H01T 13/32 313/141 |

FOREIGN PATENT DOCUMENTS

| | | | |
|---|---|---|---|
| JP | S61-135080 | | 6/1986 |
| JP | S61-135081 | | 6/1986 |
| JP | H06-060959 | | 3/1994 |
| JP | 2010-238498 | A | 10/2010 |
| JP | 2013-041754 | A | 2/2013 |
| WO | WO 2009/081563 | A1 | 2/2009 |

OTHER PUBLICATIONS

Office Action received in corresponding Japanese Patent Application No. 2015-174520, dated Sep. 6, 2016 (machine translation provided).

* cited by examiner

SPARK PLUG

RELATED APPLICATIONS

This application is a National Stage of International Application No. PCT/JP16/02771 filed Jun. 8, 2016, which claims the benefit of Japanese Patent Application No. 2015-174520, filed Sep. 4, 2015, the entire contents of which are incorporated herein by reference.

FIELD OF THE INVENTION

The present invention relates to a spark plug.

BACKGROUND OF THE INVENTION

Hitherto, a spark plug including a composite tip that includes two types of metals having different linear expansion coefficients and that is provided on an electrode has been known (see Japanese Unexamined Patent Application Publication No. H6-60959).

However, since the linear expansion coefficients differ, such a composite tip may be warped with respect to the electrode. Therefore, in such a spark plug including a composite tip, there is a demand for a technology that is capable of reducing warping of the composite tip with respect to an electrode material.

SUMMARY OF THE INVENTION

The present invention is made to address the above-described problem, and can be realized in the following forms.

(1) According to a first aspect of the present invention, there is provided a spark plug comprising a center electrode that extends in a direction of an axial line, an insulator having an axial hole for disposing the center electrode therein, a cylindrical metal shell that holds the insulator, and a ground electrode including an electrode base material whose first end portion is connected to a front end of the metal shell and a discharge tip that is joined to an inner side surface of a second end portion of the electrode base material and that faces the center electrode with a gap therebetween. In the spark plug, the discharge tip includes a discharge layer that is disposed adjacent to the center electrode and that contains a noble metal or a noble metal alloy, and an intermediate layer, a first end thereof being joined to the discharge layer and at least part of a second end thereof being joined to the electrode base material via a melted portion, the intermediate layer containing a noble metal element that is contained by a largest amount among noble metal elements that are contained in the discharge layer, an amount of the noble metal element that is contained in the intermediate layer being smaller than an amount of the noble metal element that is contained in the discharge layer, wherein when the discharge tip is viewed from the direction of the axial line, the melted portion is formed in at least a region on a second-end side of the electrode base material from a center of the discharge layer, and wherein in a section that includes a center line along a longitudinal direction of the ground electrode and that is parallel to the axial line, a proportion of a length of the melted portion along the longitudinal direction to a length of the discharge tip along the longitudinal direction is greater than or equal to 76.2%, with the length of the melted portion along the longitudinal direction being within a range in which the discharge tip exists along the longitudinal direction. According to the spark plug of such an aspect, the length of the melted portion can be a sufficient length. Therefore, it is possible to reduce warping of the discharge tip including the discharge layer and the intermediate layer from the electrode base material, and to improve the anti-peeling performance of the discharge tip.

(2) In accordance to a second aspect of the present invention, there is provided a spark plug as described above, wherein an end surface of the intermediate layer may be exposed on the second-end side of the electrode base material. According to the spark plug of such a form, an end surface of the intermediate layer is exposed on the second-end side of the electrode base material. Therefore, compared to a case in which an end surface of the intermediate layer is covered by the melted portion, it is possible to improve the anti-spark consumability of the discharge tip.

(3) In accordance to a third aspect of the present invention, there is provided a spark plug as described above, wherein an area of a surface of the discharge tip facing the center electrode may be greater than or equal to 0.75 $mm^2$. According to the spark plug of such a form, it is possible to increase the durability of the spark plug.

(4) In accordance to a fourth aspect of the present invention, there is provided a spark plug as described above, wherein the proportion may be greater than or equal to 100%. According to the spark plug of such a form, it is possible to reduce warping of the discharge tip including the discharge layer and the intermediate layer from the electrode base material, and to improve the anti-peeling performance of the discharge tip.

The present invention may be realized in various forms other than in the forms of the above-described spark plugs, such as a method of producing a spark plug.

DETAILED DESCRIPTION OF THE INVENTION

A. First Embodiment

Figure 1:
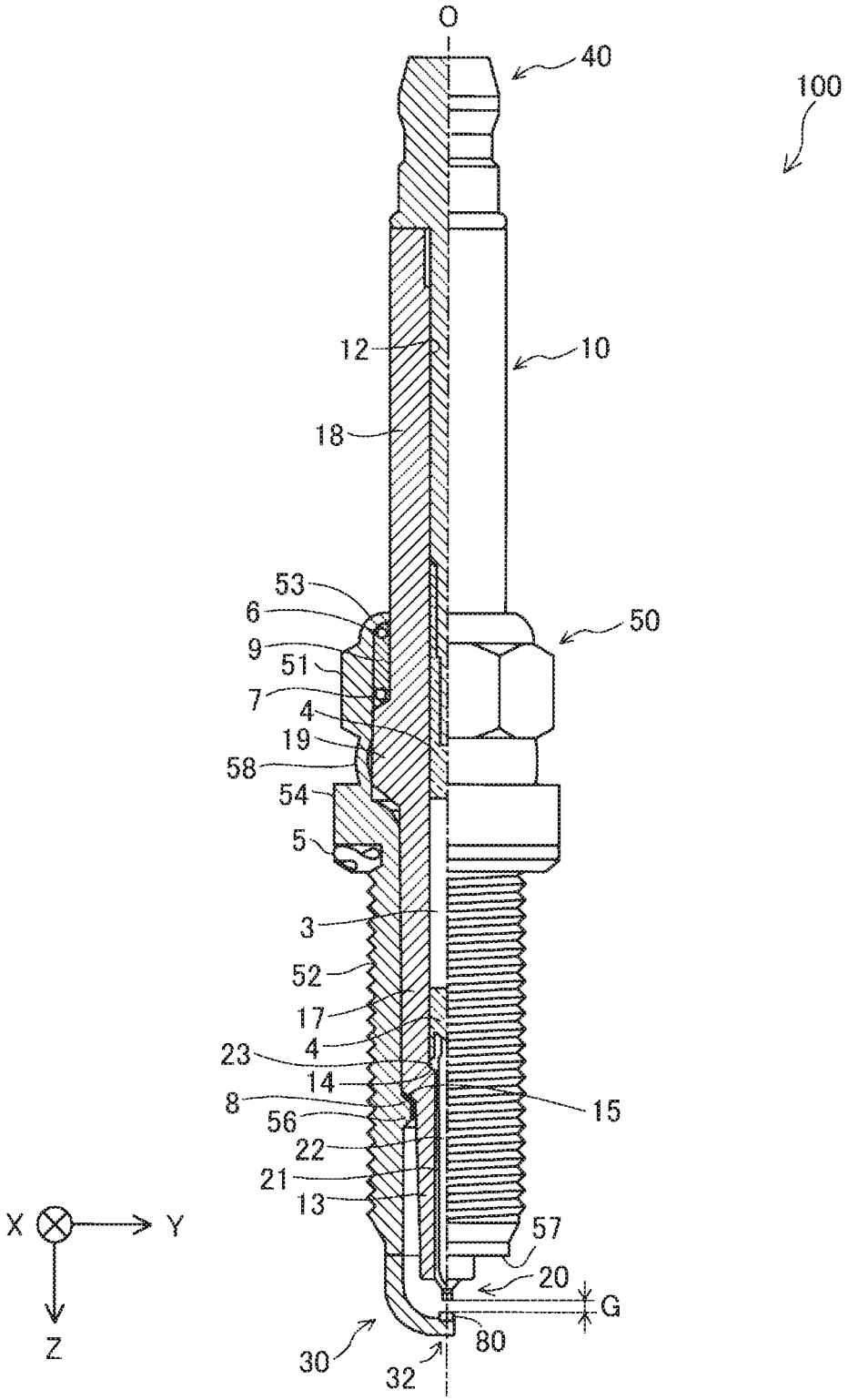
FIG. 1 is a partial sectional view of a spark plug according to an embodiment of the present invention.

A1. Structure of a Spark Plug:

FIG. 1 is a partial sectional view of a spark plug 100 according to an embodiment of the present invention. The spark plug 100 has an elongated shape along an axial line O. In FIG. 1, the right side of the axial line O indicated by an alternate long and short dash line corresponds to an external front view, and the left side of the axial line O corresponds to a sectional view in which the axial line O extends. In the description below, the lower side in FIG. 1 is called a front end side of the spark plug 100, and the upper side in FIG. 1 is called a back end side. An X axis, a Y axis and a Z axis in FIG. 1 corresponds to an X axis, a Y axis, and a Z axis in each of the other figures. The axial line O is parallel to the Z axis. In FIG. 1, the front end side of the spark plug 100 corresponds to a +Z direction, and the back end side of the spark plug 100 corresponds to a −Z direction. The term "Z direction" refers to directions parallel to the Z axis (directions along the Z axis). This similarly applies with regard to the X axis and the Y axis.

The spark plug 100 includes an insulator 10, a center electrode 20, a ground electrode 30, and a metal shell 50. At least part of an outer periphery of the insulator 10 is held by the cylindrical metal shell 50. The insulator 10 has an axial hole 12 along the axial line O. The center electrode 20 is provided in the axial hole 12. The ground electrode 30 is secured to a front end surface 57 of the metal shell 50. A discharge gap G is formed between the ground electrode 30 and the center electrode 20.

The insulator 10 is formed by sintering a ceramic material including alumina. The insulator 10 is a cylindrical member having the axial hole 12 in the center thereof, a front end side of the axial hole 12 accommodating part of the center electrode 20 and a back end side of the axial hole 12 accommodating part of a terminal metal 40. A center body portion 19 having a large outside diameter is provided at the center of the insulator 10 in an axial direction thereof. A back-end-side body portion 18 that insulates a portion between the terminal metal 40 and the metal shell 50 is provided closer to a terminal-metal-40 side than the center body portion 19. A front-end-side body portion 17 whose outside diameter is smaller than that of the back-end-side body portion 18 is provided closer to a center-electrode-20 side than the center body portion 19. An insulator nose length portion 13 whose outside diameter is smaller than that of the front-end-side body portion 17 and becomes smaller towards the center-electrode-20 side is provided beyond the front-end-side body portion 17.

The metal shell 50 is a cylindrical metal shell that surrounds and holds a portion extending from part of the back-end-side body portion 18 of the insulator 10 to the insulator nose length portion 13. The metal shell 50 is made of, for example, low-carbon steel. The entire metal shell 50 is plated with, for example, nickel or zinc. The metal shell 50 includes a tool engaging portion 51, a sealing portion 54, and a mounting threaded portion 52 in that order from the back end side. A tool for mounting the spark plug 100 on an engine head is fitted to the tool engaging portion 51. The mounting threaded portion 52 has a thread that is screwed into a mounting threaded hole in the engine head. The sealing portion 54 is provided in the form of a flange on a root of the mounting threaded portion 52. An annular gasket 5, which is made from a bent plate material, is fitted to and inserted in a portion between the sealing portion 54 and the engine head. The front end surface 57 of the metal shell 50 is hollow and has a circular shape. The insulator nose length portion 13 of the insulator 10 and the center electrode 20 project from the center of the front end surface 57.

A thin crimping portion 53 is provided closer to the back end side than the tool engaging portion 51 of the metal shell 50 is. A compression deformation portion 58 that is thin as with the crimping portion 53 is provided between the sealing portion 54 and the tool engaging portion 51. Ring members 6 and 7 are interposed between an inner peripheral surface of the metal shell 50 and an outer peripheral surface of the back-end-side body portion 18 of the insulator 10, from the tool engaging portion 51 to the crimping portion 53. A portion between the ring members 6 and 7 is filled up with talc-9 powder. When producing the spark plug 100, the compression deformation portion 58 is compressed and deformed by pressing the crimping portion 53 towards the front end side such that the crimping portion 53 is inwardly bent. By compressing and deforming the compression deformation portion 58, the insulator 10 is pressed towards the front end side in the metal shell 50 via the ring members 6 and 7 and the talc 9. By the pressing, the talc 9 is compressed in a direction of the axial line O to increase the airtightness in the metal shell 50.

At an inner periphery of the metal shell 50, an insulator stepped portion 15 that is positioned at a base end of the insulator nose length portion 13 at the insulator 10 is pressed against a metal shell inner stepped portion 56, which is provided at the mounting threaded portion 52, via an annular plate packing 8. The plate packing 8 is a material that maintains the airtightness between the metal shell 50 and the insulator 10 and that prevents combustion gas from flowing out.

The center electrode 20 is a bar-shaped member in which a core material 22 whose thermal conductivity is higher than that of a center electrode base material 21 is buried in the center electrode base material 21. The center electrode base material 21 is composed of a nickel alloy whose main component is nickel. The core material 22 is composed of copper or an alloy whose main component is copper.

A flange 23 that projects towards an outer peripheral side is provided near a back end portion of the center electrode 20. The flange 23 contacts, from the back end side, an axial hole inner stepped portion 14, which is formed at the axial hole 12, to position the center electrode 20 in the insulator 10. The back end portion of the center electrode 20 is electrically connected to the terminal metal 40 via a ceramic resistor 3 and a sealing body 4.

The ground electrode 30 is made of a metal having high anticorrosiveness. Examples of metals having high anticorrosiveness include nickel alloys whose main component is nickel, such as Inconel (tradename) 600 and Inconel 601. A base end of the ground electrode 30 is welded to the front end surface 57 of the metal shell 50. In the embodiment, an intermediate portion of the ground electrode 30 is bent so that a side surface of a front end portion of the ground electrode 30 faces the center electrode 20. A square columnar discharge tip 80 that projects towards the center electrode 20, which is the other electrode, and that forms the discharge gap G is provided on an inner surface of a front end portion (second end portion) 32 of the ground electrode 30. The axial line O in FIG. 1 extends through a center P of the discharge tip 80.

Figure 2:
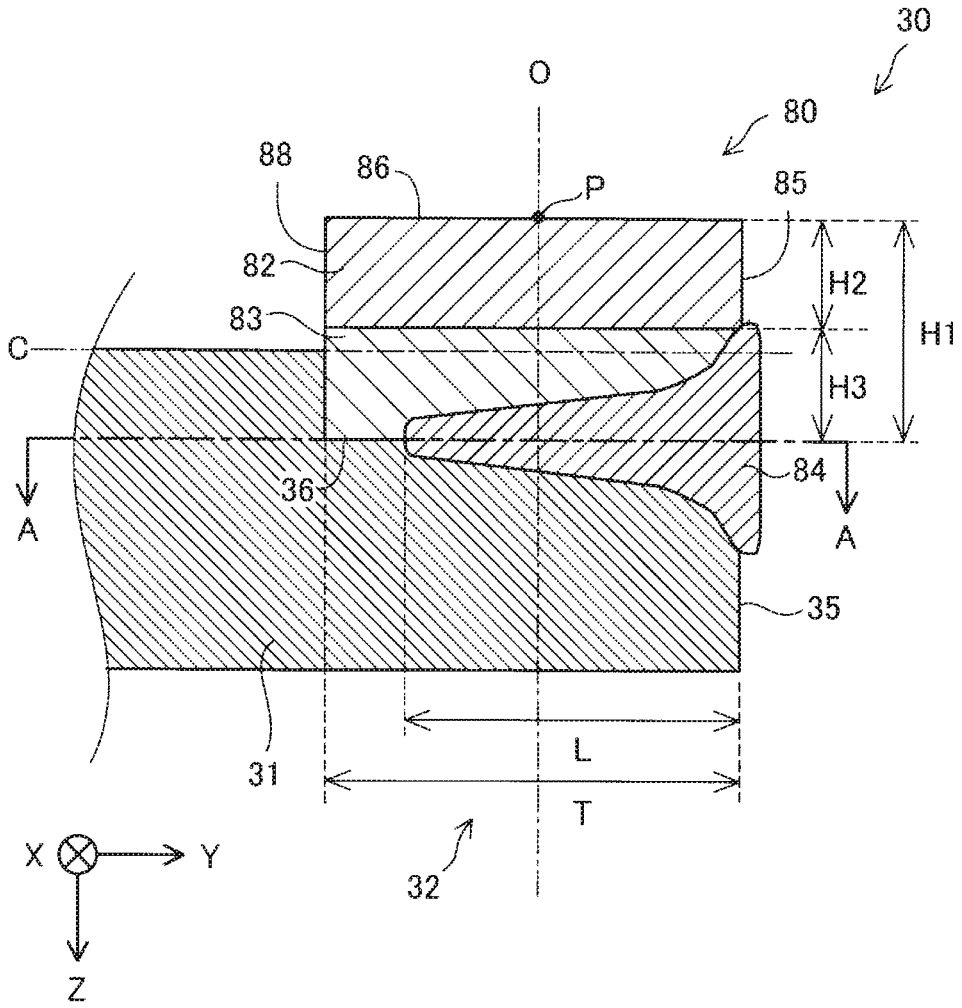
FIG. 2 is a longitudinal sectional view of a front end portion of a ground electrode.

FIG. 2 is a longitudinal sectional view of the front end portion 32 of the ground electrode 30. The longitudinal sectional view of FIG. 2 is a section that includes a center line C along a longitudinal direction of the ground electrode 30 and that is parallel to the axial line O. The center line C of the ground electrode 30 is a line that divides the ground electrode 30 in two in a width direction and that extends along the longitudinal direction of the ground electrode 30. In the embodiment, the intermediate portion of the ground electrode 30 is bent so as to face the center electrode 20, with the longitudinal direction of the ground electrode 30 corresponding to the Y direction. The width direction of the ground electrode 30 is parallel to the X-axis direction. The Y-axis direction is perpendicular to the X-axis direction and the Z-axis direction, and is parallel to the longitudinal direction of the ground electrode 30. The ground electrode 30 includes an electrode base material 31, the discharge tip 80, and a melted portion 84. The discharge tip 80 is a clad member including a discharge layer 82 and an intermediate layer 83 that are joined to each other. The discharge tip 80 according to the embodiment has a columnar shape and a square-shaped surface 86 that faces the center electrode 20. In FIG. 2 and the descriptions that follow, the discharge tip 80 is such that the +Y direction corresponds to a front end 85 and the −Y direction corresponds to a back end 88.

The discharge layer 82 is disposed adjacent to the center electrode 20. The discharge layer 82 contains a noble metal or a noble metal alloy, and is made of, for example, platinum (Pt), iridium (Jr), ruthenium (Ru), rhodium (Rh), or an alloy thereof. A first end of the intermediate layer 83 is joined to the discharge layer 82, and at least part of a second end of the intermediate layer 83 is welded to the electrode base material 31. The second end of the intermediate layer 83 shown in FIG. 2 also includes a boundary portion 36 between the intermediate layer 83 and the electrode base material 31. The intermediate layer 83 contains a noble metal element that is contained by the largest amount in the discharge layer 82, and an element that is contained in the electrode base material 31. The amount of noble metal element that is contained in the intermediate layer 83 is less than that contained in the discharge layer 82 in mass percentage. More specifically, for example, when the discharge layer 82 is made of a Pt—Ir based alloy, the intermediate layer 83 contains a smaller amount of Pt than the discharge layer 82 in mass percentage ratio; and, for example, a Pt—Ni based alloy containing nickel that is contained in the electrode base material 31 is used. Such a clad member including the discharge layer 82 and the intermediate layer 83 is formed by, for example, performing rolling while applying heat to the discharge layer 82 and the intermediate layer 83.

The melted portion 84 is positioned near the boundary portion 36 between the intermediate layer 83 and the electrode base material 31. The melted portion 84 extends from a front-end-85 side of the discharge tip 80 (+Y direction) in a longitudinal direction (−Y direction) of the electrode base material 31. The melted portion 84 is formed by melting and solidifying the intermediate layer 83 and the electrode base material 31 by laser beam welding. The melted portion 84 contains a noble metal element that is contained in the intermediate layer 83 and an element that is contained in the electrode base material 31. The total amount of noble metal element in the melted portion 84 is, for example, 2.8 mass % or less. The melted portion 84 is a layer for reducing thermal stress that is generated when the spark plug 100 is used in addition to joining the discharge tip 80 to the electrode base material 31 by joining the intermediate layer 83 and the electrode base material 31 to each other.

FIG. 2 also illustrates, along the axial line O, a height H1 of the discharge tip 80, a height H2 of the discharge layer 82, and a height H3 of the intermediate layer 83. FIG. 2 further illustrates a length T of the discharge tip 80 along the longitudinal direction of the ground electrode 30 (−Y direction) (hereunder referred to as the "length T"), and a length L of the melted portion 84 along a longitudinal direction thereof in a range in which the discharge tip 80 exists along the longitudinal direction (hereunder referred to as the "depth L"). The depth L is also the length of the melted portion 84 towards the back end 88 of the discharge tip 80 from the front end 85 of the discharge tip 80 that is positioned at a second-end-35 side of the electrode base material 31. In the embodiment, a proportion D of the depth L to the length T (hereunder referred to as the "proportion D") is greater than or equal to 76.2% and less than 100%.

The height H1 of the discharge tip 80 is greater than or equal to 0.30 mm and less than or equal to 0.65 mm, and is 0.50 mm in the embodiment. The length T of the discharge tip 80 is greater than or equal to 1.0 mm and less than or equal to 2.0 mm, and is 1.8 mm in the embodiment. A ratio H1/T between the height H1 and the length T of the discharge tip 80 is greater than or equal to 0.20 and less than or equal to 0.45, and is 0.28 in the embodiment. A ratio H2/H3 between the height H2 of the discharge layer 82 and the height H3 of the intermediate layer 83 is greater than or equal to 0.30 and less than or equal to 2.05, and is 1.0 in the embodiment. The area of the surface 86 of the discharge tip 80 facing the center electrode 20 is greater than or equal to 0.75 $mm^2$.

Figure 3:
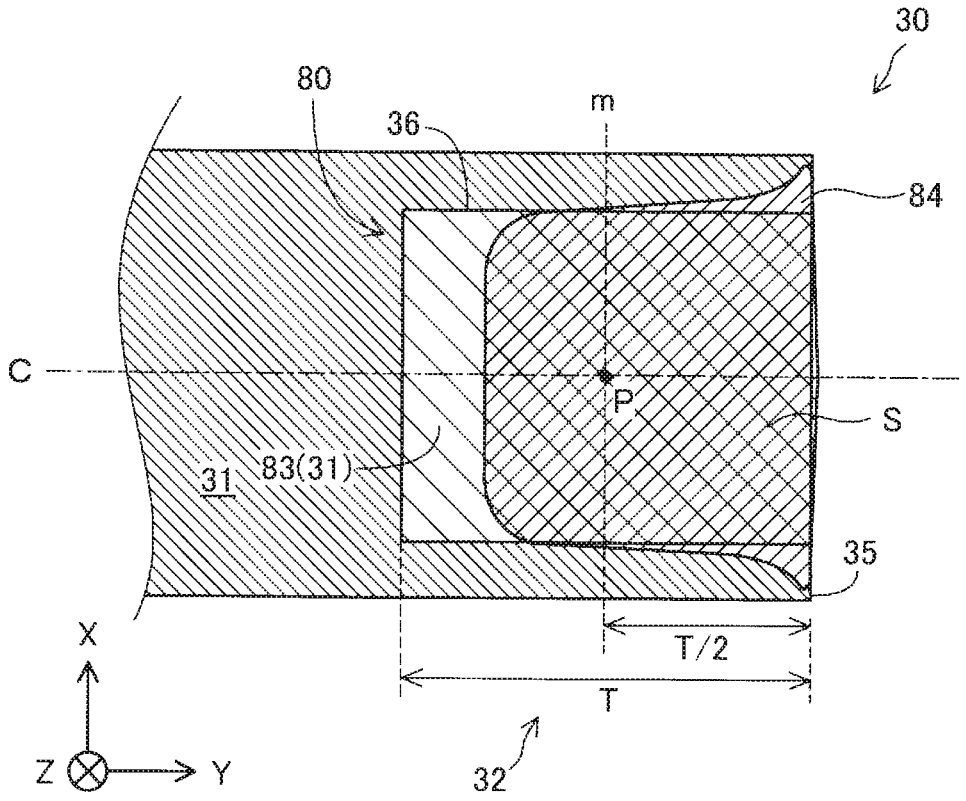
FIG. 3 is a transverse sectional view of the front end portion of the ground electrode.

FIG. 3 is a transverse sectional view of the front end portion 32 of the ground electrode 30. The transverse sectional view of FIG. 3 is a sectional view along A-A in FIG. 2 and includes the boundary portion 36. FIG. 3 illustrates the center P of the discharge tip 80, a straight line m that extends through the center P of the discharge tip 80 and that is parallel to the width direction (X-axis direction) of the ground electrode 30, the center line C of the ground electrode, and a region S (cross-hatched region) of the discharge tip 80 where the melted portion 84 is formed. In the embodiment, the center P of the discharge tip 80 is also the center of the discharge layer 82.

As shown in FIG. 3, the melted portion 84 is also formed further beyond the straight line m in the −Y direction. In other words, when the discharge tip 80 is viewed from the −Z direction, the melted portion 84 is formed in at least the entire region on the second-end-35 side of the electrode base material 31 from the center P of the discharge tip 80 (region up to a depth T/2 of the discharge tip 80). Although, as shown in FIG. 3, the region S can be confirmed by observing the transverse section of the front end portion 32 of the ground electrode 30, the region S can also be confirmed by observing the discharge tip 80 from the −Z direction by using X rays (CT scan).

In the embodiment, the spark plug 100 is produced as follows. First, the metal shell 50, the insulator 10, the center electrode 20, and the electrode base material 31 are prepared. Then, the electrode base material 31 that has not been bent yet is joined to the metal shell 50. Independently of this, the center electrode 20 and the insulator 10 are assembled to each other. Then, an assembling step in which the insulator 10 to which the center electrode 20 has been assembled is assembled to the metal shell 50 to which the electrode base material 31 has been joined is performed. After the assembling step, a crimping step of the metal shell 50 is performed. By the crimping step, the insulator 10 is fixed to the metal shell 50. The gasket 5 is mounted between the sealing portion 54 and the mounting threaded portion 52 of the metal shell 50.

After the crimping step is performed, the discharge tip 80 is welded to the electrode base material 31 by laser beam welding. The method of welding the electrode base material 31 and the discharge tip 80 by laser beam welding is described below. After laser beam welding is performed, the ground electrode 30 is bent such that a side surface of the front end portion 32 of the ground electrode 30 faces the center electrode 20. By performing the above, the spark plug 100 is completed. The above-described production method is one example. It is possible to produce the spark plug by performing various other methods that differ from the above-described method. For example, the order of the above-described steps can be changed at one's discretion.

Figure 4:
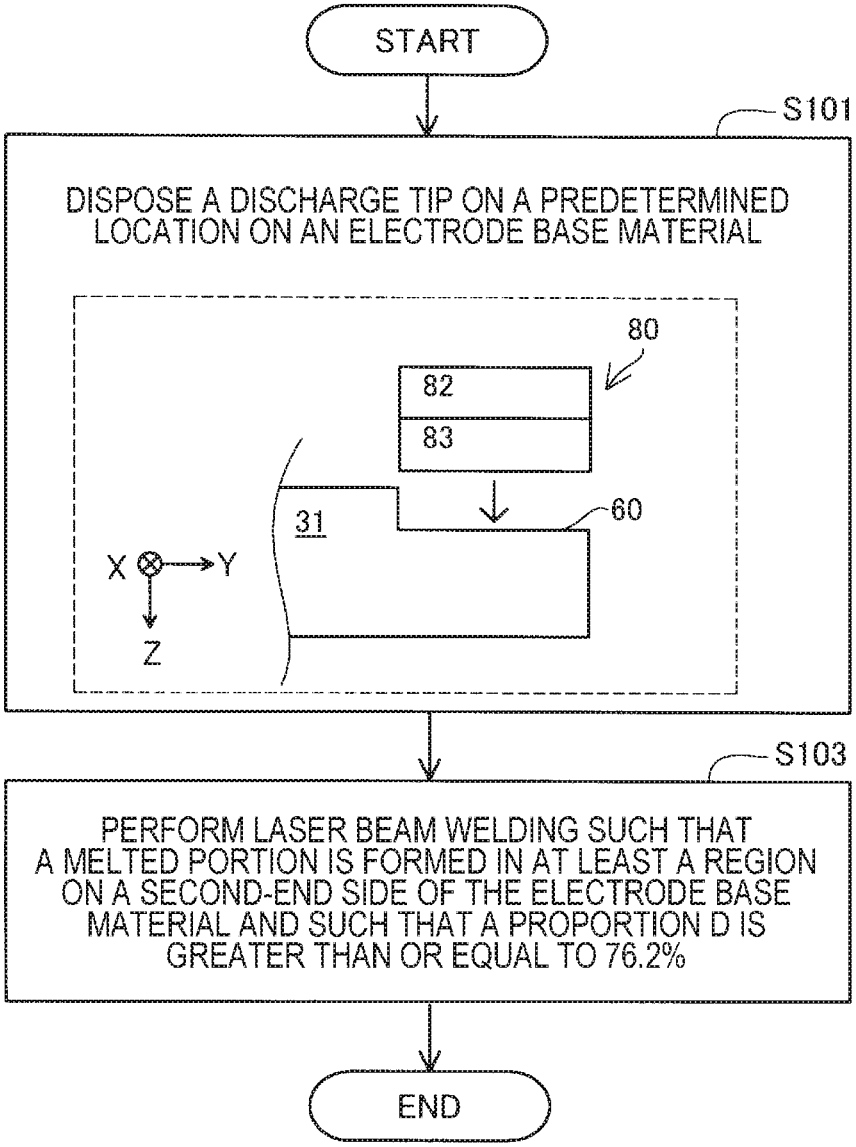
FIG. 4 is a flow chart of a method of welding an electrode base material and a discharge tip to each other by laser beam welding.

A2. Method of welding the electrode base material and the discharge tip by laser beam welding: FIG. 4 is a flow chart of a method of welding the electrode base material 31 and the discharge tip 80 to each other by laser beam welding. First, the discharge tip 80 is disposed on a predetermined location on the electrode base material 31 (Step S101). In the embodiment, a depression 60 for disposing the discharge tip 80 is formed in the front end portion 32 of the electrode base material 31, and the discharge tip 80 is disposed in the depression 60 in the front end portion 32 of the discharge tip 80. In Step S101, the electrode base material 31 and the discharge tip 80 may be welded to each other by resistance welding for tentatively securing them, or may be secured to each other by using a jig.

Next, a laser beam welding step in which the boundary portion 36 between the electrode base material 31 and the discharge tip 80 is irradiated with laser beams is performed (Step S103).

Figure 5A:
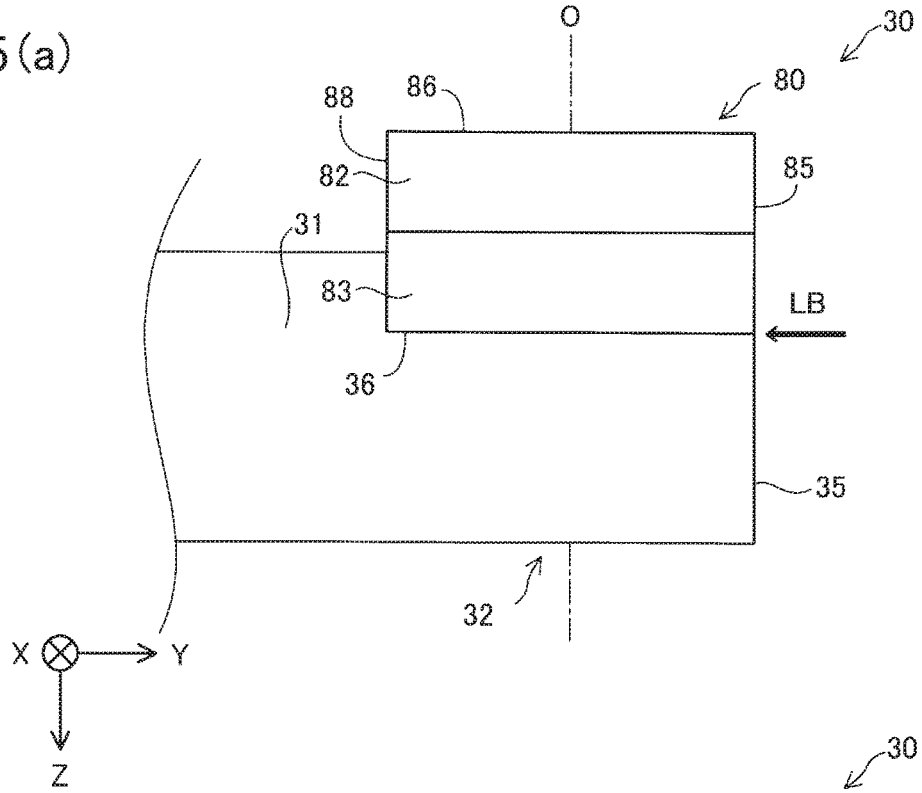
FIGS. 5(A) and 5(B) are schematic views of a state of a laser beam welding step.
Figure 5B:
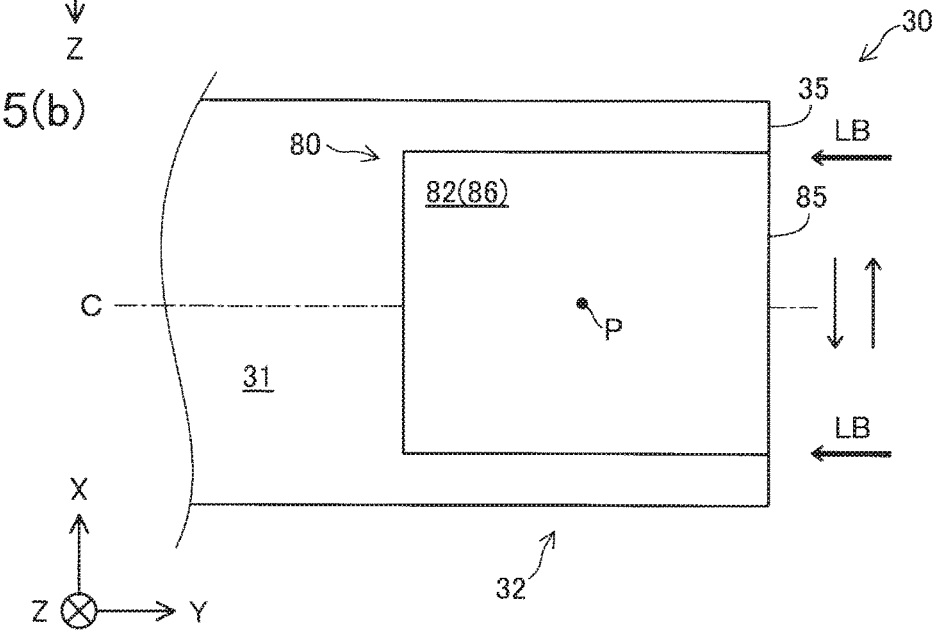

FIGS. 5(A) and 5(B) are schematic views of a state of the laser beam welding step. FIG. 5(*a*) is a view of the laser beam welding step when it is seen from the −X direction, and FIG. 5(*b*) is a view of the laser beam welding step when it is seen from the −Z direction. In Step S103, as shown in FIG. 5(*a*), the boundary portion 36 between the electrode base material 31 and the discharge tip 80 is irradiated with a laser beam LB that is parallel to the boundary portion 36 from the +Y direction, which corresponds to the second-end-35 side of the ground electrode 30. As shown in FIG. 5(*b*), laser beams LB scan the entire front end 85 of the discharge tip 80. As the laser beams LB, for example, fiber laser beams having high energy may be used. The laser beams LB need not illuminate the boundary portion 36 so as to be parallel to the boundary portion 36. For example, the light beams LB may be tilted in a range of −5° to 5° in the Z direction with respect to the boundary portion 36 to illuminate the boundary portion 36.

Accordingly, the melted portion 84 is formed by applying laser beams such that, when the discharge tip 80 is viewed from the −Z direction, the melted portion 84 is formed in at least a region on the second-end-35 side of the electrode base material 31 from the center P of the discharge tip 80, and such that the proportion D becomes greater than or equal to 76.2%. It is possible to form such a melted portion 84 by, with the relationships between laser output values, laser scan speed, the region S, and the proportion D being determined as a result of carrying out experiments, using laser power and scan speed that allow the region S to be formed in at least the region on the second-end-35 side of the electrode base material 31 from the center P of the discharge tip 80, and that allow the proportion D to become greater than or equal to 76.2%.

The spark plug 100 according to the embodiment described above allows the depth of the melted portion 84 to be a sufficient depth in addition to allowing the melted portion 84 to be sufficiently formed in the region on the second-end-35 side of the electrode base material 31. Therefore, the spark plug 100 makes it possible to reduce warping of the discharge tip 80 including the discharge layer 82 and the intermediate layer 83 from the electrode base material 31. Consequently, it is possible to improve the anti-peeling performance of the discharge tip 80. Since the discharge tip 80 is a clad member including the discharge layer 82 and the intermediate layer 83, it is possible to increase the durability of the spark plug 100 by the discharge layer 82, and to reduce thermal stress that is generated due to a difference between the linear expansion coefficient of the discharge layer 82 and the linear expansion coefficient of the electrode base material 31 by the intermediate layer 83.

Since the area of the surface 86 of the discharge tip 80 facing the center electrode 20 is greater than or equal to 0.75 $mm^2$, it is possible to increase the durability of the spark plug 100.

The grounds for forming the spark plug 100 such that, when the discharge tip 80 is viewed from the −Z direction, the melted portion 84 is formed in at least a region on the second-end-35 side of the electrode base material 31 from the center P of the discharge tip 80, and such that the proportion D becomes greater than or equal to 76.2% are described below on the basis of the results of experiments.

Figure 6:
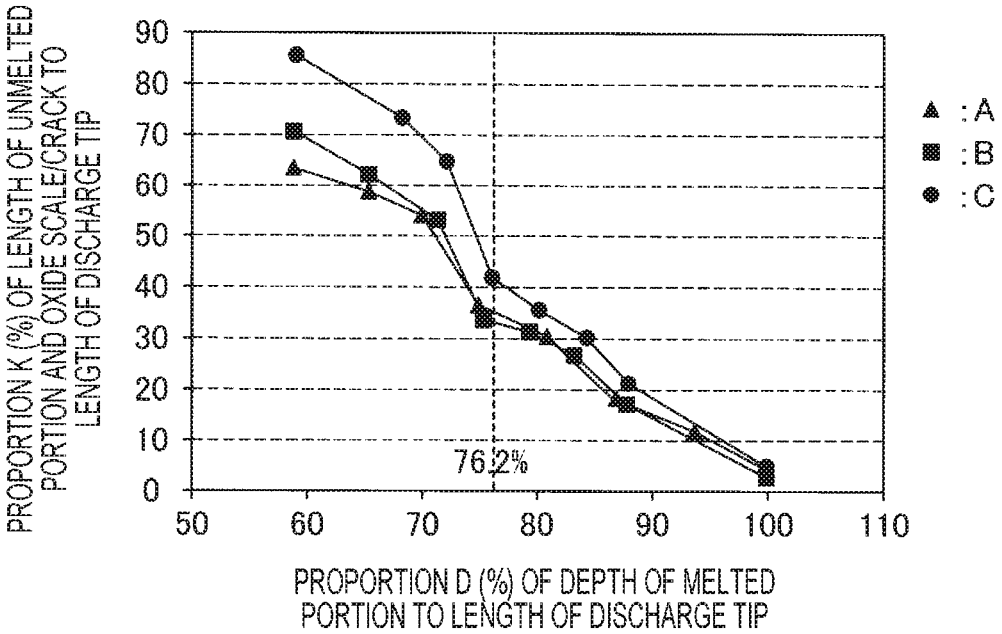
FIG. 6 is a graph of the results of experiments carried out for determining an optimum range of a proportion D.

A3. Content of experiments and results of experiments: FIG. 6 is a graph of the results of experiments carried out for determining an optimum range of proportion D. In the experiments, in the above-described laser beam welding method (Step S103 in FIG. 4), the output values of laser beams LB and the scan speeds of laser beams LB were changed to provide different proportions D. Three spark plugs having corresponding proportions D and discharge tips 80 with the following shapes and materials were produced. In the experiments, laser beams LB were applied such that, when each discharge tip 80 was viewed from the −Z direction, a melted portion 84 was formed in at least a region on a second-end-35 side of an electrode base material 31. The discharge tips 80 were discharge tips having the following three types of shapes and made of the following three types of materials. The electrode base materials 31 were made of Inconel 601.

<Discharge tip A> shape: cylindrical, area of a surface 86 facing a center electrode: 0.79 $mm^2$ (diameter 1.0 mm), material of discharge layer: Pt—Ir based alloy, material of intermediate layer: Pt—Ni based alloy.

<Discharge tip B> shape: square columnar, area of a surface 86 facing a center electrode: 1.3 $mm^2$, material of discharge layer: Pt—Ir based alloy, material of intermediate layer: Pt—Ni based alloy.

<Discharge tip C> shape: square columnar, area of a surface 86 facing a center electrode 20: 1.5 $mm^2$, material of discharge layer: Ir-based alloy, material of intermediate layer: Ir—Pt—Ni based alloy.

Next, in order to evaluate the relationships between each proportion D and the anti-peeling performance of its corresponding discharge tip 80, a thermal cyclic test was carried out. In the thermal cyclic test, first, a front end portion 32 of each ground electrode 30 was heated for two minutes with a burner to raise the temperature of each ground electrode 30 to 1050° C. Thereafter, the burner was turned off, and each ground electrode 30 was slowly cooled for one minute and was reheated for two minutes with the burner to raise the temperature of each ground electrode 30 to 1050° C. This cycle was repeated 1000 times.

Next, each ground electrode 30 was cut into a section including a center line C thereof and being parallel to an axial line O. In each section (longitudinal section shown in FIG. 2), the sum of the length of a boundary portion 36 where the intermediate layer 83 and the electrode base material 31 were not melted and the length of an oxide scale and a crack in the melted portion 84 occurring near the boundary portion 36 was measured. In each spark plug 100, a proportion K of the sum of the lengths to a length T of the discharge tip was determined. The smaller the proportion K, the lower the possibility of peeling of the discharge tip 80 from the electrode base material 31. In addition, a proportion D of a depth L of each melted portion 84 to the length T of the corresponding discharge tip 80 was determined. Further, the proportion D and the proportion K of the three spark plugs produced under the same conditions were averaged to determine the relationship between the proportion D and the proportion K.

As shown in FIG. 6, as the proportion D increased, the proportion K decreased. That is, as the length of each melted portion between the discharge tip 80 and the electrode base material 31 increased, the possibility of peeling of each discharge tip 80 from the corresponding electrode base material 31 decreased. In addition, it was found that when the proportion D became greater than or equal to 76.2%, the proportion K was significantly reduced than when the proportion D was less than 76.2%, so that the occurrence of an oxide scale and a crack was reduced to the extent allowing a reduction in the peeling of each discharge tip 80. The shapes of the discharge tips did not cause a significant difference between anti-peeling performances.

The aforementioned results show that it is desirable that, when each discharge tip 80 is viewed from the −Z direction, the melted portion 84 be formed in at least a region on the second-end-35 side of the electrode base material 31 from a center P of the discharge tip 80 and that the proportion D of the depth L of the melted portion 84 to the length T of the discharge tip 80 be greater than or equal to 76.2%.

B. Second Embodiment: B1. Structure of a Spark Plug

Figure 7:
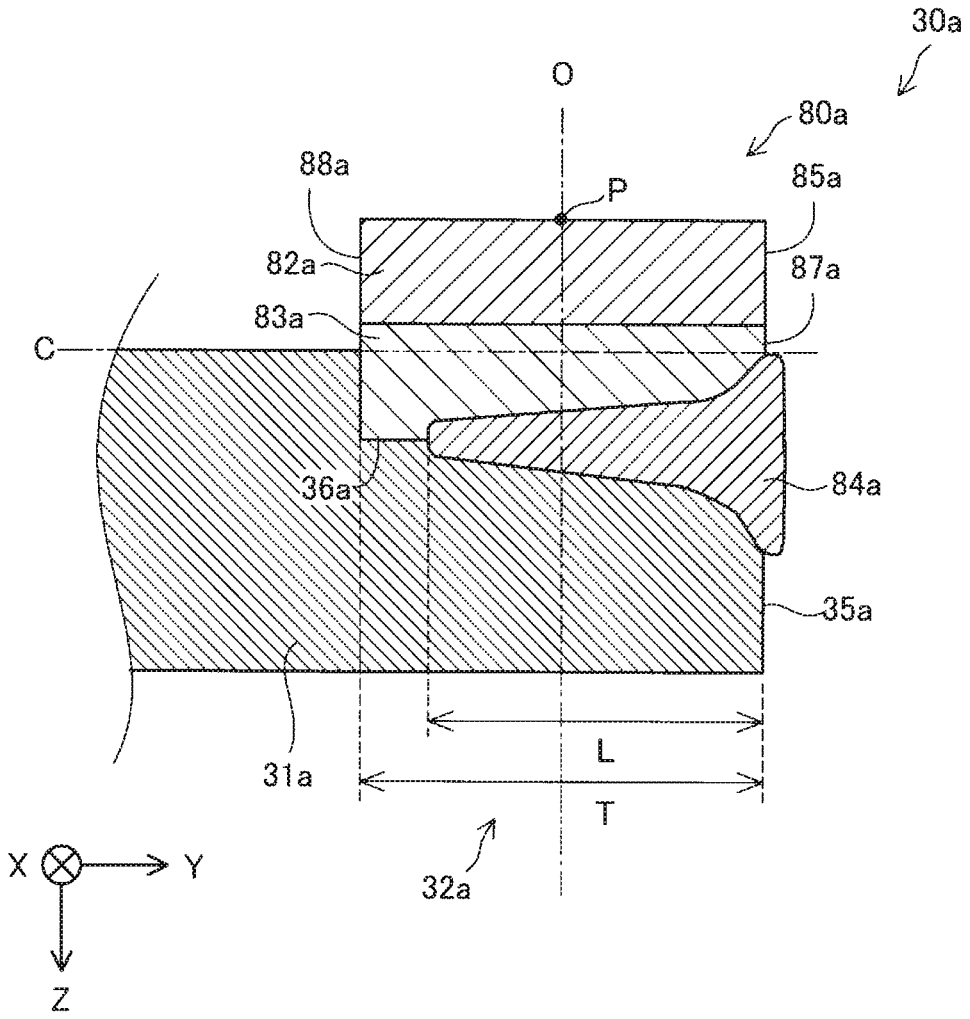
FIG. 7 is a longitudinal sectional view of a front end portion of a ground electrode of a spark plug according to a second embodiment.

FIG. 7 is a longitudinal sectional view of a front end portion 32*a* of a ground electrode 30*a* of a spark plug according to a second embodiment. The longitudinal sectional view shown in FIG. 7 is parallel to an axial line O and includes a center line C of the ground electrode 30*a*. In the ground electrode 30*a* according to the embodiment, an end surface 87*a* of an intermediate layer 83*a* of a discharge tip 80*a* is exposed at a second-end-35*a* side of an electrode base material 31*a*. Even in the spark plug according to this embodiment, as in the spark plug according to the first embodiment, when the discharge tip 80*a* is viewed from the −Z direction, a melted portion 84*a* is formed in at least a region on the second-end-35*a* side of the electrode base material 31*a* from a center P of the discharge tip 80*a* (discharge layer 82*a*), and a proportion D of a depth L of the melted portion 84*a* is greater than or equal to 76.2%. The other structural features of the spark plug are the same as those of the spark plug 100 according to the first embodiment, and are thus not described.

The ground electrode 30*a* where the end surface 87*a* is exposed on the second-end-35*a* side of the electrode base material 31*a* can be formed by adjusting as appropriate the output values of laser beams LB, the scan speed of the laser beams LB, and the irradiation angle of the laser beams LB with respect to a boundary portion 36*a* such that the end surface 87*a* is exposed in the above-described laser beam welding step (Step S103 in FIG. 4).

The spark plug according to the second embodiment described above is such that when the discharge tip 80*a* is viewed from the −Z direction, the melted portion 84*a* is formed in at least the region on the second-end-35*a* side of the electrode base material 31*a* from the center P of the discharge tip 80*a*, and such that the proportion D of the depth L of the melted portion 84*a* to the length T of the discharge tip 80*a* is greater than or equal to 76.2%. Therefore, the same effects as those of the first embodiment are provided.

Since the intermediate layer 83*a* contains a noble metal element that is contained by the largest amount in the discharge layer 82*a*, the intermediate layer 83*a* has higher anti-spark consumability than the melted portion 84*a* formed by melting the electrode base material 31*a* and the intermediate layer 83*a*. In the spark plug according to the second embodiment, the end surface 87*a* of the intermediate layer 83*a* of the discharge tip 80*a* is exposed on the second-end-35*a* side of the electrode base material 31*a*. Therefore, even if a discharge occurs in the spark plug on a front-end-85*a* side of the discharge tip 80*a*, it is possible to further increase anti-spark consumability compared to that of the spark plug 100 according to the first embodiment in which the intermediate layer 83 is covered by the melted portion 84.

FIG. 7 illustrates a state in which the end surface 87*a* of the intermediate layer 83*a* is exposed in the longitudinal section including the center line C of the ground electrode 30*a*. However, as long as the spark plug is a spark plug in which the end surface 87*a* is exposed on the second-end-35*a* side of the electrode base material 31*a*, the same effects as those of the second embodiment are provided.

C. Modifications: C1. First Modification

In the above-described various embodiments, the discharge tip 80 includes one discharge layer 82 and one intermediate layer 83, and the discharge tip 80*a* includes one discharge layer 82*a* and one intermediate layer 83*a*. In contrast, a discharge tip 80*c* may include two or more intermediate layers.

Figure 8:
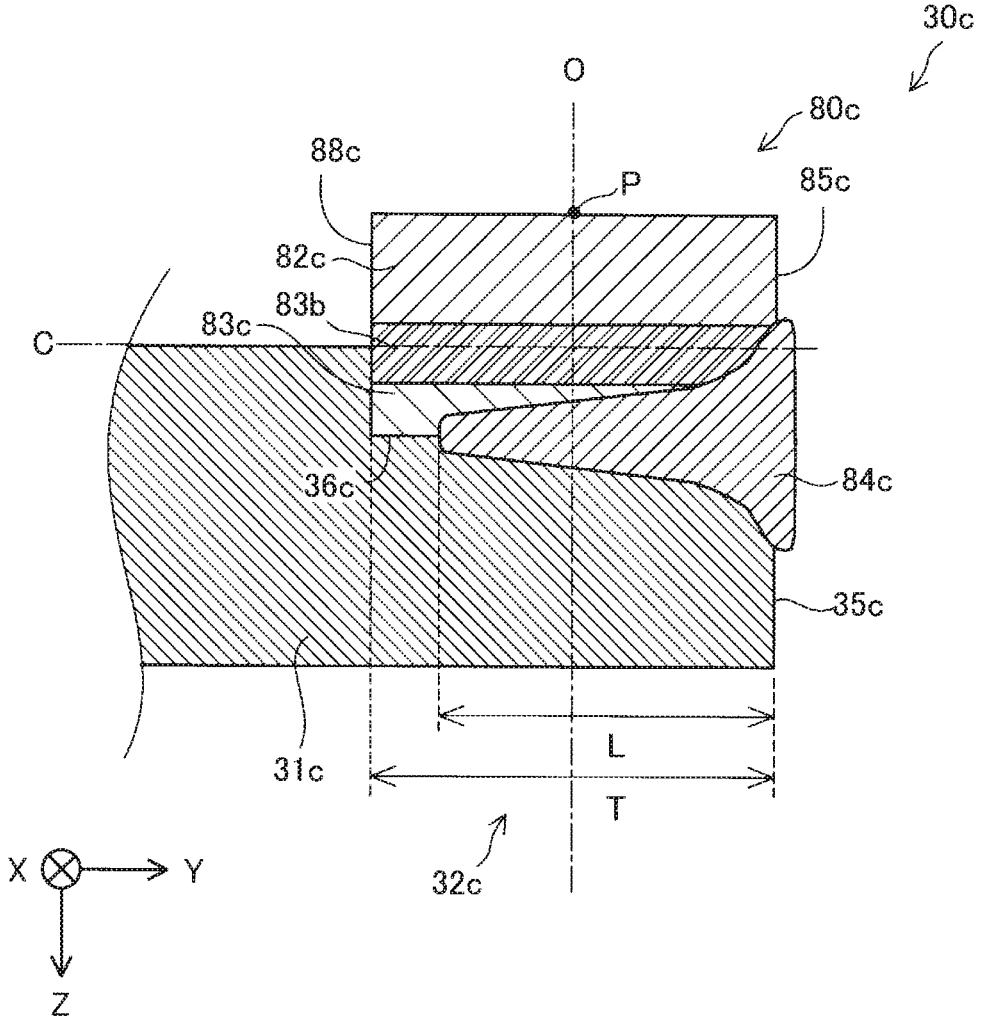
FIG. 8 is a longitudinal sectional view of a front end portion of a ground electrode.

FIG. 8 is a longitudinal sectional view of a front end portion 32*c* of a ground electrode 30*c*. In the ground electrode 30*c* shown in FIG. 8, the discharge tip 80*c* includes a discharge layer 82*c*, a first intermediate layer 83*b*, and a second intermediate layer 83*c*. The first intermediate layer 83*b* contains a noble metal element (such as Pt) that is contained by the largest amount in the discharge layer 82*c*, and an element (such as Ni) that is contained in an electrode base material 31*c*. The second intermediate layer 83*c* contains the noble metal element (such as Pt) that is contained by the largest amount in the discharge layer 82*c* by an amount that is smaller than the amount of the noble metal element that is contained in the first intermediate layer 83*b*. The second intermediate layer 83*c* contains the element (such as Ni) that is contained in the electrode base material 31*c* by an amount that is larger than the amount of the element that is contained in the first intermediate layer 83*b*.

Such a discharge tip 80*c* is such that the second intermediate layer 83*c* contains an element (such as Ni) contained in the electrode base material 31*c* by an amount that is larger than the amount of the element that is contained in the first intermediate layer 83*b*. Therefore, compared to when a discharge tip includes only the first intermediate layer 83*b*, the discharge tip 80*c* tends to be melted due to the electrode base material 31*c*. Therefore, a proportion D of a depth L of a melted portion 84*c* is a sufficient proportion, so that it is possible to improve the anti-peeling performance of the discharge tip 80*c*. In addition, compared to when a discharge tip only includes the first intermediate layer 83*b*, the amount of noble metal element that is used in the discharge tip 80*c* can be reduced, so that the costs of producing spark plugs can be reduced.

C2. Second modification: In the above-described various embodiments. The columnar discharge tips 80 and 80*a* have the square-shaped surfaces 86 and 86*a*, respectively, that face the center electrode 20. The surfaces 86 and 86*a* of the corresponding discharge tips 80 and 80*a* may have rectangular columnar shapes or circular columnar shapes. That is, the shapes of the discharge tips 80 and 80*a* are not limited to those in the above-described embodiments, and thus any other shapes may be used.

Figure 9:
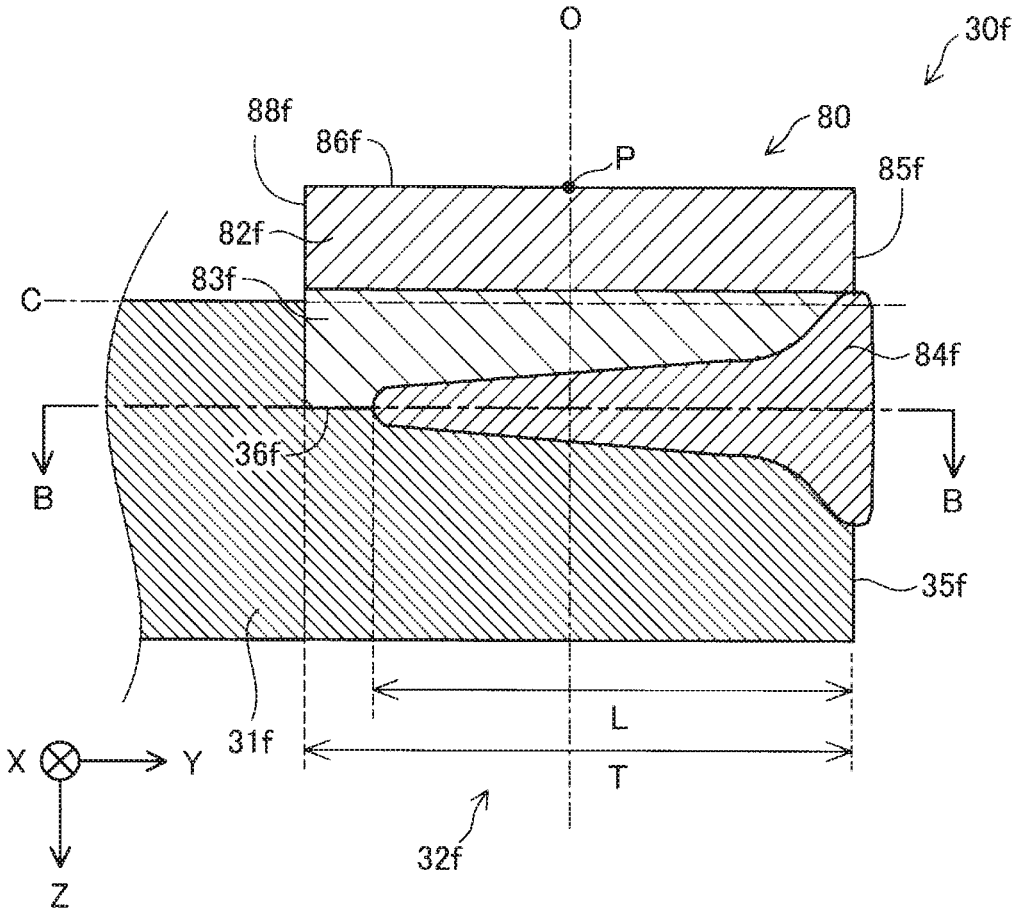
FIG. 9 is a longitudinal sectional view of a front end portion of a ground electrode.
Figure 10:
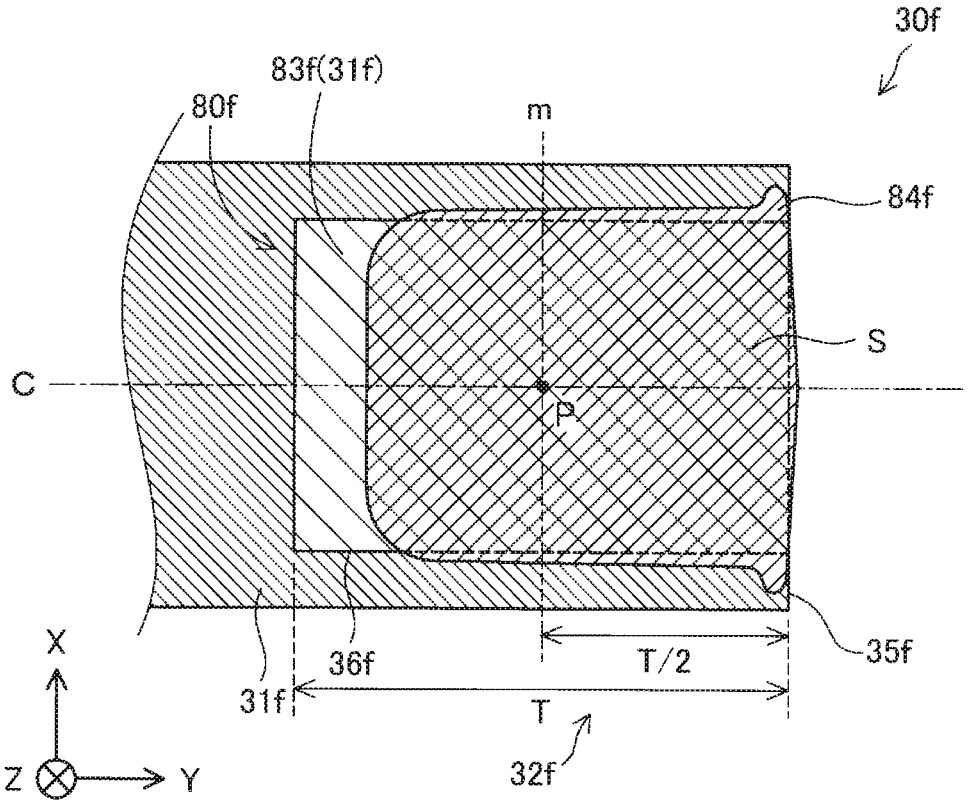
FIG. 10 is a transverse sectional view of the front end portion of the ground electrode.

FIG. 9 is a longitudinal sectional view of a front end portion 32*f* of a ground electrode 30*f*. The longitudinal sectional view shown in FIG. 9 is parallel to an axial line O and includes a center line C of the ground electrode 30*f*. FIG. 10 is a transverse sectional view of the front end portion 32*f* of the ground electrode 30*f*. FIG. 10 is a sectional view along B-B in FIG. 9 and includes a boundary portion 36*f*. A discharge tip 80*f* shown in FIGS. 9 and 10 has a columnar shape, and a surface 86*f* thereof facing a center electrode 20 has a rectangular shape. Even in the discharge tip 80*f* having such a shape, as shown in FIG. 9, as long as a proportion D of a depth L of a melted portion 84*f* to a length T is greater than or equal to 76.2%; and, as shown in FIG. 10, as long as, when the discharge tip 80*f* is viewed from the −Z direction, the melted portion 84*f* is formed in at least a region on a second-end-35*f* side of an electrode base material 31*f* from a center P of the discharge tip 80*f* (discharge layer 82*f*), the same effects as those according to the above-described first embodiment are provided.

C3. Third modification: In the above-described various embodiments, the second end 35 of the ground electrode 30 and the front end 85 of the discharge tip 80 are aligned with each other, and the second end 35*a* of the ground electrode 30*a* and the front end 85*a* of the discharge tip 80*a* are aligned with each other. In addition, the second end 35 and the front end 85 and the second end 35*a* and the front end 85*a* are positioned in the same XZ plane. However, the second end 35 of the ground electrode 30 and the front end 85 of the discharge tip 80 need not be aligned with other; and the second end 35*a* of the ground electrode 30*a* and the front end 85*a* of the discharge tip 80*a* need not be aligned with each other.

Figure 11:
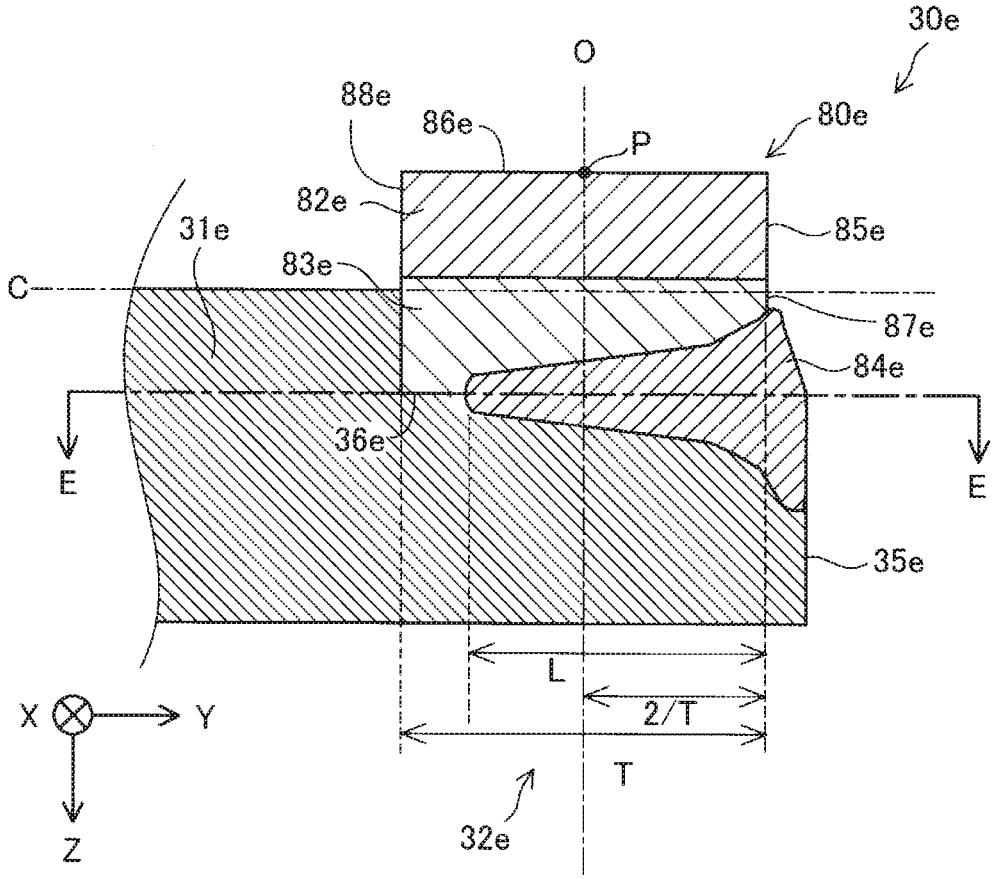
FIG. 11 is a longitudinal sectional view of a front end portion of a ground electrode.
Figure 12:
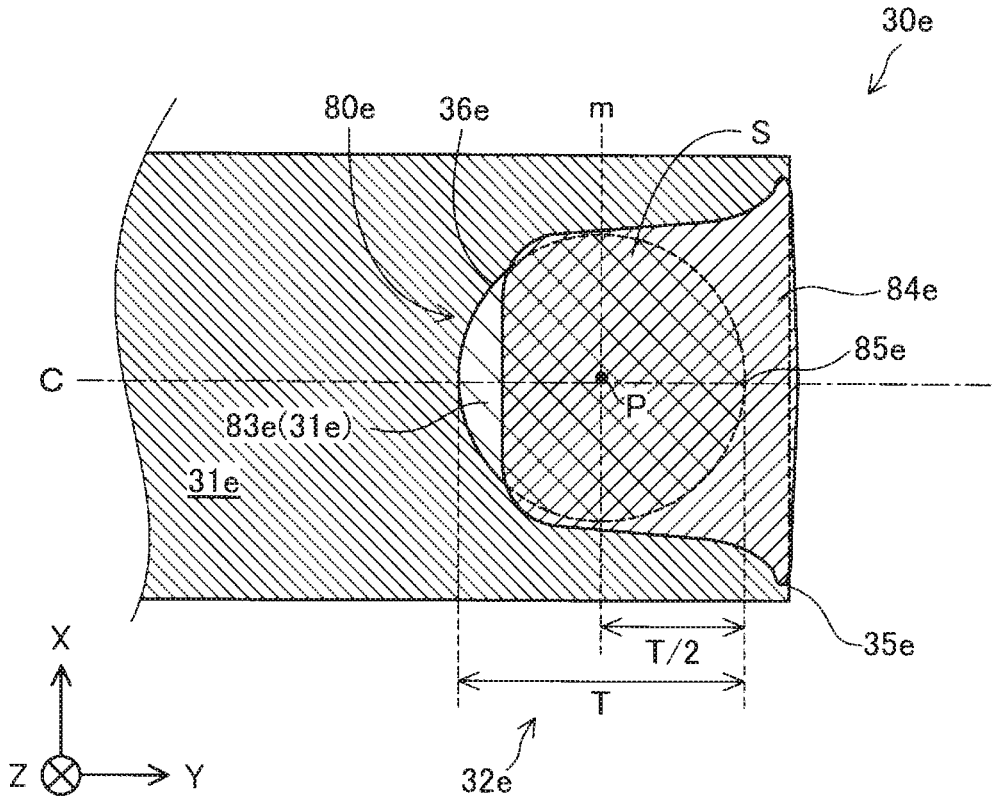
FIG. 12 is a transverse sectional view of the front end portion of the ground electrode.

FIG. 11 is a longitudinal sectional view of a front end portion 32*e* of a ground electrode 30*e*. The longitudinal sectional view shown in FIG. 11 is parallel to an axial line O and includes a center line C of the ground electrode 30*e*. FIG. 12 is a transverse sectional view of the front end portion 32*e* of the ground electrode 30*e*. FIG. 12 is a sectional view along E-E in FIG. 11 and includes a boundary portion 36*e*. In the ground electrode 30*e*, a second end 35*e* of the ground electrode 30*e* and a front end 85*e* of a discharge tip 80*e* are not aligned with each other and are thus not positioned in the same XZ plane. As shown in FIG. 11, a melted portion 84*e* is such that a proportion D of a depth L is greater than or equal to 76.2%. An end surface 87*e* of an intermediate layer 83*e* is exposed. Further, as shown in FIG. 12, when the discharge tip 80*e* is viewed from the −Z direction, a melted portion 84*e* is formed in at least a region on a second-end-35*e* side of an electrode base material 31*e* from a center P of the discharge tip 80*e* (discharge layer 82*e*). Even such a spark plug including the ground electrode 30*e* provides the same effects as those of the above-described second embodiment.

C4. Fourth modification: In the above-described various embodiments, the discharge tip 80 is welded to the depression 60 of the electrode base material 31 by laser beam welding, and the discharge tip 80*a* is welded to the depression 60 of the electrode base material 31*a* by laser beam welding. However, the discharge tip 80 may be directly welded to a flat surface of the electrode base material 31 without forming the depression 60 in the electrode base material 31, and the discharge tip 80*a* may be directly welded to a flat surface of the electrode base material 31*a* without forming the depression 60 in the electrode base material 31*a*.

C5. Fifth modification: In each of the above-described various embodiments, the proportion D of the depth L of the melted portion is greater than or equal to 76.2% and less than 100%. However, the proportion D may be greater than or equal to 100%.

Figure 13:
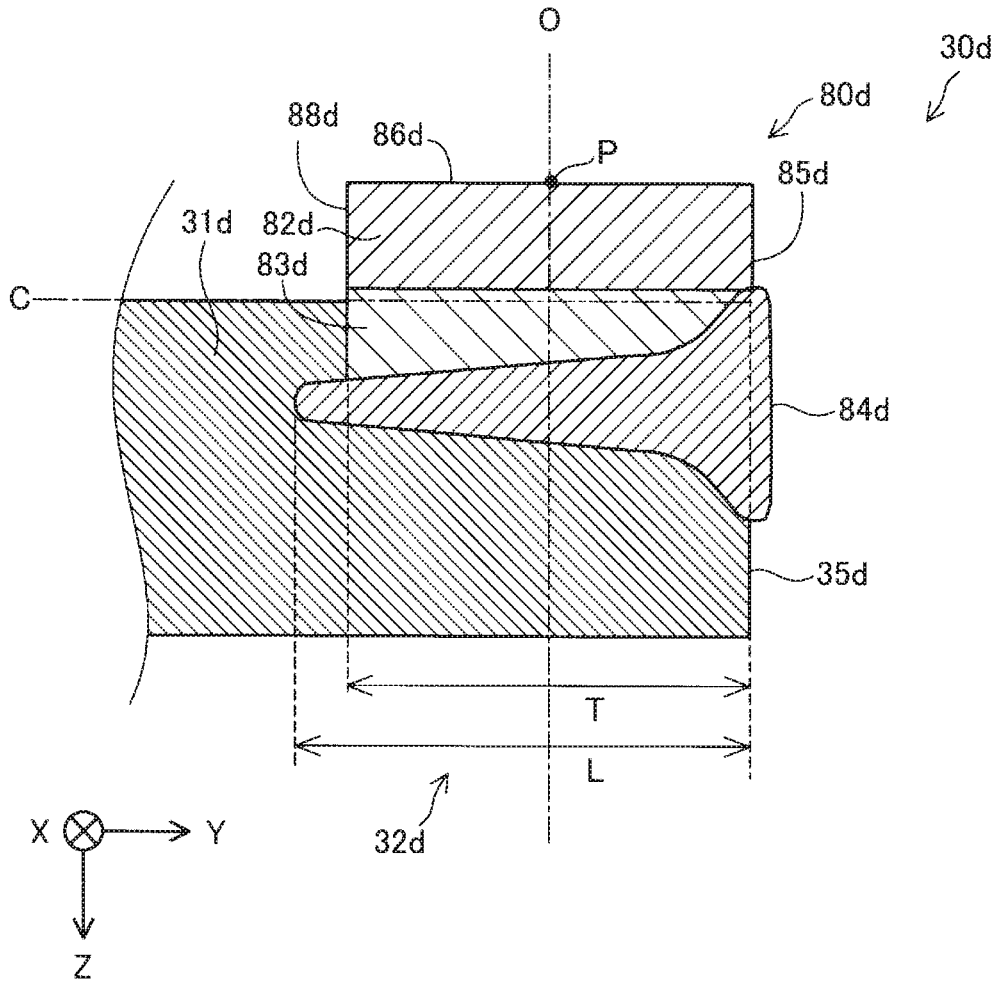
FIG. 13 is a longitudinal sectional view of a front end portion of a ground electrode.

FIG. 13 is a longitudinal sectional view of a front end portion 32*d* of a ground electrode 30*d*. The longitudinal sectional view shown in FIG. 13 is parallel to an axial line O and includes a center line C of the ground electrode 30*d*. In the ground electrode 30*d* shown in FIG. 13, a proportion D of a depth L is greater than or equal to 100%. As with the ground electrode 30*d* shown in FIG. 13, when a boundary portion between a discharge tip 80*d* and an electrode base material 31*d* in longitudinal section cannot be seen, a length T of the discharge tip 80*d* may be measured by measuring a length T of the discharge tip 80*d* corresponding to the boundary portion (a maximum length of the discharge tip 80*d* along the longitudinal direction). A depth L of a melted portion 84*d* may be measured by measuring a length L towards a back end 88*d* from a front end 85*d* of the discharge tip 80*d* along the longitudinal direction. Although not illustrated, when the discharge tip 80*d* is viewed from the −Z direction, the melted portion 84*d* is formed in at least a region on a second-end-35*d* side of the electrode base material 31*d* from a center P of the discharge tip 80*d*.

In this way, when the proportion D is greater than or equal to 100%, it is possible to reduce warping of the discharge tip 80*d* from the electrode base material 31*d*, and to improve the anti-peeling performance of the discharge tip 80*d*.

C6. Sixth modification: In the above-described first embodiment, the area of the surface 86 of the discharge tip 80 facing the center electrode 20 is greater than or equal to 0.75 $mm^2$. In contrast, the area of the surface 86 may be less than 0.75 $mm^2$.

The present invention is not limited to the above-described embodiments and modifications, so that various structures can be realized within a scope that does not depart from the gist of the present invention. For example, any of the technical features in the embodiments and modifications corresponding to the technical features in the aspect and forms described in the "Summary of Invention" section may be replaced with another or may be combined with another as appropriate for solving some or all of the aforementioned problems or for realizing some or all of the aforementioned effects. If the technical features thereof are not described as being essential in the description, they may be omitted as appropriate.

REFERENCE SIGNS LIST

3 ceramic resistor
4 sealing body
5 gasket
6 ring member
8 plate packing

9 talc
10 insulator
12 axial hole
13 insulator nose length portion
14 axial hole inner stepped portion
15 insulator stepped portion
17 front-end-side body portion
18 back-end-side body portion
19 center body portion
20 center electrode
21 center electrode base material
22 core material
23 flange
30, 30*a*, 30*c*, 30*d*, 30*e*, 30*f* ground electrode
31, 31*a*, 31*c*, 31*d*, 31*e*, 31*f* electrode base material
32, 32*a*, 32*c*, 32*d*, 32*e*, 32*f* front end portion
35, 35*a*, 35*e* second end
36, 36*a*, 36*e*, 36*f* boundary portion
40 terminal metal
50 metal shell
51 tool engaging portion
52 mounting threaded portion
53 crimping portion
54 sealing portion
56 metal shell inner stepped portion
57 front end surface
58 compression deformation portion
60 depression
80, 80*a*, 80*c*, 80*d*, 80*e*, 80*f* discharge tip
82, 82*a*, 82*c*, 82*d*, 82*e*, 82*f* discharge layer
83, 83*a*, 83*e* intermediate layer
83*b* first intermediate layer
83*c* second intermediate layer
84, 84*a*, 84*c*, 84*d*, 84*f* melted portion
85, 85*d*, 85*e* front end of discharge tip
86, 86*f* surface of discharge tip facing center electrode
87*a*, 87*e* end surface of intermediate layer
88, 88*d* back end of discharge tip
100 spark plug
C center line of ground electrode
G discharge gap
LB laser beam
O axial line
P center of discharge layer
S region
m straight line Having described the invention, the following is claimed:

1. A spark plug, comprising:
a center electrode that extends in a direction of an axial line;
an insulator having an axial hole for disposing the center electrode therein;
a cylindrical metal shell that holds the insulator; and
a ground electrode, comprising:
an electrode base material having first end portion connected to a front end of the metal shell; and
a discharge tip that is joined to an inner side surface of a second end portion of the electrode base material and that faces the center electrode with a gap therebetween, the discharge tip comprising:
a discharge layer disposed adjacent to the center electrode, the discharge layer containing a noble metal or a noble metal alloy; and
an intermediate layer, a first end thereof being joined to the discharge layer, at least part of a second end thereof being joined to the electrode base material via a melted portion, the intermediate layer containing a noble metal element that is contained by a largest amount among noble metal elements that are contained in the discharge layer,
wherein
an amount of the noble metal element that is contained in the intermediate layer is less than an amount of the noble metal element that is contained in the discharge layer,
wherein, when the discharge tip is viewed from the direction of the axial line, the melted portion is formed in at least a region on a second-end side of the electrode base material from a center of the discharge layer, and
wherein, in a section that includes a center line along a longitudinal direction of the ground electrode and that is parallel to the axial line, a proportion of a length of the melted portion along the longitudinal direction to a length of the discharge tip along the longitudinal direction is greater than or equal to 76.2%, with the length of the melted portion along the longitudinal direction being within a range in which the discharge tip exists along the longitudinal direction.

2. The spark plug according to claim 1, wherein an end surface of the intermediate layer is exposed on the second-end side of the electrode base material.

3. The spark plug according to claim 1, wherein an area of a surface of the discharge tip facing the center electrode is greater than or equal to 0.75 $mm^2$.

4. The spark plug according to claim 1, wherein the proportion is greater than or equal to 100%.

* * * * *